US009528364B2

(12) United States Patent
Samuel et al.

(10) Patent No.: US 9,528,364 B2
(45) Date of Patent: Dec. 27, 2016

(54) WELL INTEGRITY MANAGEMENT USING COUPLED ENGINEERING ANALYSIS

(71) Applicant: Landmark Graphics Corporation, Houston, TX (US)

(72) Inventors: Robello Samuel, Houston, TX (US); Aniket, Houston, TX (US)

(73) Assignee: Landmark Graphics Corporation, Houston, TX (US)

( * ) Notice: Subject to any disclaimer, the term of this patent is extended or adjusted under 35 U.S.C. 154(b) by 502 days.

(21) Appl. No.: 14/029,271

(22) Filed: Sep. 17, 2013

(65) Prior Publication Data

US 2014/0214326 A1 Jul. 31, 2014

Related U.S. Application Data

(60) Provisional application No. 61/756,790, filed on Jan. 25, 2013.

(51) Int. Cl.
*E21B 47/00* (2012.01)

(52) U.S. Cl.
CPC ..... *E21B 47/00* (2013.01)

(58) Field of Classification Search
None
See application file for complete search history.

(56) References Cited

U.S. PATENT DOCUMENTS

| | | | | |
|---|---|---|---|---|
| 3,974,690 | A * | 8/1976 | Brock, Jr. | G01L 19/00 73/152.51 |
| 7,660,673 | B2 * | 2/2010 | Dozier | E21B 43/26 175/50 |
| 8,073,623 | B2 | 12/2011 | Hartmann et al. | |
| 2008/0133194 | A1 * | 6/2008 | Klumpen | E21B 49/00 703/10 |
| 2013/0191038 | A1 | 7/2013 | Wolf et al. | |
| 2014/0032192 | A1 * | 1/2014 | Zamora | E21B 44/00 703/10 |

FOREIGN PATENT DOCUMENTS

| | | | |
|---|---|---|---|
| WO | 2010014471 A2 | 2/2010 | |
| WO | WO 2010014471 A2 * | 2/2010 | F17D 5/00 |

OTHER PUBLICATIONS

Australian Patent Office, Office Action, Australian Patent Application No. 2013375225, Oct. 15, 2015, 3 pages, Australian Patent Office, Australia.
Colin MaCauley, Response to Office Action, Australian Patent Application No. 2013375225, Nov. 20, 2015, 4 pages, Fisher Adams Kelly Callinans, Brisbane, QLD.
Yukari Nakamura,International Preliminary Report on Patentability; PCT/US13/60054; Aug. 20, 2015; 11 pages.

(Continued)

*Primary Examiner* — Aditya Bhat
(74) *Attorney, Agent, or Firm* — Crain, Caton & James; Tenley Krueger

(57) ABSTRACT

Systems and methods for well integrity management in all phases of development using a coupled engineering analysis to calculate a safety factor, based on actual and/or average values of various well integrity parameters from continuous real-time monitoring, which is compared to a respective threshold limit.

20 Claims, 7 Drawing Sheets

(56) References Cited

OTHER PUBLICATIONS

Shane Thomas, The International Search Report and the Written Opinion of the International Searching Authority, PCT/US13/60054, Mar. 25, 2014, 20 pages.
D.J. Galr, T.P. Moulds; Tubular Corrosion in the West Sole Gas Field; SPE 11879 PA; dated May 1988; 6 pages; SPE; Aberdeen, South Dakota.
Yves Gunaltun, Ussama Kaewpradap, Marc Singer, Srdjan Nesic, Suchada Punpruk, Matina Thammachart; Progress in the Prediction of Top of the Line Corrosion and Challenges to Predict Corrosion Rates Measured in Gas Pipelines; NACE Paper No. 10093; dated 2010; 21 pages; NACE; Houston, Texas.
A. R. Crabtree, H. Skrzypek; Investigation of Coiled Tubing Failures Over 2 Years and Corrosion Prevention Methods; SPE 46024; dated Apr. 15, 1998; 9 pages; Houston,Texas.
J.R.Shadley, S.A. Shirazi, E. Dayalan, E.F. Rybicki; Prediction of Erosion-Corrosion Penetration Rate in a carbon Dioxide Environment with Sand; dated Dec. 1998; 7 pages; NACE; Houston, Texas.
TMK IPSCO Achieves ERCB Directive 010 Compliance; PR Newswire Association LLC; dated Dec. 9, 2009; 2 pages; New York, USA.
Kia Sun, Robello Samuel, Boyun Guo; Effect of Stress Concentration Factors due to Corrosion on Production Tubing Design; SPE 90094; dated Sep. 26, 2004; 6 pages; Houston, Texas.
AS. Halali, D.J. Warling, R.R, Wagner; Minimum Cost Casing Design; SPE 36448; dated Oct. 6, 1996; 11 pages; Denver, Colorado.
Terry N. Toye, Sr.,Tony Pantaleo, Jr., Mark D. Rheinlander; Coiled Tubing Inspection and Tubing Management: A Case Study; SPE 60748; dated Apr. 5, 2000; 7 pages; Houston, Texas.
D.E. Mowat, M.C. Edgeton, E.H.R. Wade; Erskine Field HPHT Workover and Tubing Corrosion Failure Investigation;SPE/IADC 67779; dated Feb. 27, 2001; 10 pages; Amsterdam, The Netherlands.
Robello, Samuel; Theory and Practice for Students and Engineers; dated 2007; 3 pages; Gulf Publishing, USA; Downhole Drilling Tools.
Well integrity in drilling and well operations; Norsok Standard D-010; dated Aug. 3, 2004, 162 pages; Standards Norway; Norway.
Formulas and Calculations for Casing, Tubing, Drill Pipe and Line Pipe Properties; API Bul 5C3 Fourth Edition; Dated Feb. 1, 1985; 42 pages; Dallas, Texa.
G. Robello Samuel; Gonzales Adolfo; Wellhead growth index aids multistring casing design; Oil and Gas Journal; dated Oct. 30, 2000; 3 pages; Houston, Texas.
Fitz-Hardy, Christopher, G.; First Examination Report; dated Jun. 29, 2016; 4 pages; Patent Application No. 2895400; Canadian Intellectual Property Office; Canada.

* cited by examiner

WELL INTEGRITY MANAGEMENT USING COUPLED ENGINEERING ANALYSIS

CROSS-REFERENCE TO RELATED APPLICATIONS

The priority of U.S. Provisional Patent Application No. 61/756,790, filed on Jan. 25, 2013, is hereby claimed and the specifications thereof are incorporated herein by reference.

STATEMENT REGARDING FEDERALLY SPONSORED RESEARCH

Not applicable.

FIELD OF THE DISCLOSURE

The present disclosure generally relates to systems and methods for well integrity management using a coupled engineering analysis. More particularly, the disclosure relates to well integrity management in all phases of development using a coupled engineering analysis to calculate a safety factor, based on actual and/or average values of various well integrity parameters from continuous real-time monitoring, which is compared to a respective threshold limit.

BACKGROUND

Managing well barriers and maintaining well integrity within limits is challenging for aging wells and has a major effect on extending the life of wells and reducing operational costs. This is important for both the design phase and the operational phase of a well. As more real-time data become available, the efficient use of quality data for analysis has become important. Little has been done to include some of the more important engineering analyses in this process such as, for example, analysis of wellhead movement, annular pressure buildup, maximum allowable surface pressure, temperature and pressure effects on the well integrity, casing corrosion and erosion, zonal isolation and estimation of a tubing or casing safety factor, which may all bear on a quantifiable monitoring system. Standard methods and guidelines are traditionally used before or after a well integrity incident occurs, but the key to savings and success is avoiding the risks associated with such incidents. Continuous monitoring helps identify the risk involved with the engineering analysis rather than setting simple limits and following the workflow process. If risks are identified early, better solutions can be provided to reduce the associated costs and take remedial action.

BRIEF DESCRIPTION OF THE DRAWINGS

The present disclosure is described below with references to the accompanying drawings in which like elements are referenced with like reference numerals, and in which.

DETAILED DESCRIPTION OF THE PREFERRED EMBODIMENTS

Figure 1:
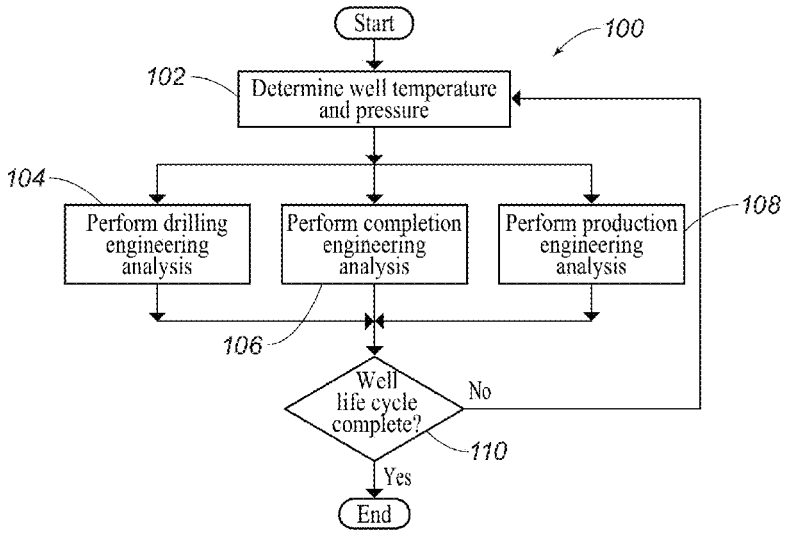
FIG. 1 is a flow diagram illustrating one embodiment of a method for implementing the present disclosure.

The present disclosure therefore, overcomes one or more deficiencies in the prior art by providing well integrity management in all phases of development using a coupled engineering analysis to calculate a safety factor, based on actual and/or average values of various well integrity parameters from continuous real-time monitoring, which is compared to a respective threshold limit.

SUMMARY OF THE INVENTION

In one embodiment, the present disclosure includes a method for well integrity management using a coupled engineering analysis, which comprises: a) performing drilling operations and a drilling engineering analysis based on a temperature and a pressure for a well during drilling the operations using a computer processor, wherein the drilling engineering analysis determines a casing integrity, a wellbore integrity, a surface equipment integrity and a drillstring integrity; b) performing completion operations and a completion engineering analysis based on a temperature and a pressure for the well during the completion operations using the computer processor, wherein the completion engineering analysis determines a casing integrity, a tubing integrity, a surface equipment integrity and a completion string integrity; and c) performing production operations and a production engineering analysis based on a temperature and a pressure for the well during production the operations using the computer processor, wherein the production engineering analysis determines at least one of a metal loss, a type of corrosion, a tubing yield strength, an erosion velocity and an erosion rate.

In another embodiment, the present disclosure includes a non-transitory program carrier device tangibly carrying computer executable instructions for well integrity management using a coupled engineering analysis, the instructions being executable to implement: a) performing drilling operations and a drilling engineering analysis based on a temperature and a pressure for a well during the drilling operations, wherein the drilling engineering analysis determines a casing integrity, a wellbore integrity, a surface equipment integrity and a drillstring integrity; b) performing completion operations and a completion engineering analysis based on a temperature and a pressure for the well during the completion operations, wherein the completion engineering analysis determines a casing integrity, a tubing integrity, a surface equipment integrity and a completion string integrity; and c) performing production operations and a production engineering analysis based on a temperature and a pressure for the well during the production operations, wherein the production engineering analysis determines at least one of a metal loss, a type of corrosion, a tubing yield strength, an erosion velocity and an erosion rate.

In yet another embodiment, the present disclosure includes a non-transitory program carrier device tangibly carrying computer executable instructions for well integrity management using a coupled engineering analysis, the instructions being executable to implement: a) performing drilling operations and a drilling engineering analysis based on a temperature and a pressure for a well during the drilling operations, wherein the drilling engineering analysis determines a casing integrity, a wellbore integrity, a surface equipment integrity and a drillstring integrity; b) performing completion operations and a completion engineering analysis based on a temperature and a pressure for the well during the completion operations, wherein the completion engineering analysis determines a casing integrity, a tubing integrity, a surface equipment integrity and a completion string integrity; c) performing production operations and a production engineering analysis based on a temperature and a pressure for the well during the production operations, wherein the production engineering analysis determines a metal loss, a type of corrosion, a tubing yield strength, an erosion velocity and an erosion rate; and d) repeating steps a)-c) until a life cycle of the well is complete.

The subject matter of the present disclosure is described with specificity, however, the description itself is not intended to limit the scope of the disclosure. The subject matter thus, might also be embodied in other ways, to include different steps or combinations of steps similar to the ones described herein, in conjunction with other present or future technologies. Moreover, although the term "step" may be used herein to describe different elements of methods employed, the term should not be interpreted as implying any particular order among or between various steps herein disclosed unless otherwise expressly limited by the description to a particular order. While the present disclosure may be applied in the oil and gas industry, it is not limited thereto and may also be applied in other industries to achieve similar results.

Method Description

Quantifying the complexity of well integrity can be based on physical reasoning and can be characterized with safety factors for load conditions. This will provide additional insight about the severity of risk involved. The present disclosure therefore, provides a coupled engineering analysis. This methodology puts the engineering calculations under one quantifiable value to test the susceptibility of the string under various conditions. The load profiles based on the top of the cement, production and injection operations, and the history of the well are important to ensure the integrity of the well. For example, sustained annulus pressures in the annuli are an indication of barrier failures, which, in turn, affects the integrity of the casing, tubing, and well as a whole.

The coupled engineering analyses may address various parameters such as wellhead movement, annular pressure buildup, maximum allowable surface pressure, temperature and pressure effects on well integrity, casing wear, corrosion, erosion, zonal isolation and a tubing or casing safety factor. The results of this analysis suggest that well integrity should be monitored in real time so that the engineering calculations can be calibrated for better prediction, thereby reducing risk factors under different discrete operation scenarios. The estimation of the risk and risk factors are essential at the start of a project. Due to uncertainties involved while drilling, these factors need to be updated with all available data. The coupled engineering analysis is carried out to prevent erroneous results when considered in isolation. Individual risk factors are estimated to arrive at a comprehensive unified approach. Individual risk factors also provide background risk estimates.

Well integrity management using a coupled engineering analysis addresses the importance of all phases of well construction and may be used in connection with assets where the wells are produced for many years. Besides monitoring the well integrity, management is essential to develop the assets in an economical way so that long-term sustained production can be maintained. Most of the well-integrity issues stem from the following problems:

- wellhead movement;
- annular pressure buildup;
- corrosion of tubing/casing
- erosion of the tubing/casing; and
- temperature.

Wellhead movement can result from several reasons, such as temperature cycling or subsidence of formation; thus, it can be of wellhead growth or wellhead subsidence. Annular pressure buildup may be a result of thermal effects or because of communication between the annuli, and the challenges associated with the sustained annuli pressures in various annuli. The corrosion is another important problem in managing the well integrity and may be because of improper tubing and casing strings used in the past and may result in quick degradation or failure of the strings. The corrosion is a complex problem and has to be combined with engineering, as well as a physical monitoring system. When erosional velocity is exceeded, the threshold velocity increases the degradation of the thickness of the tubulars and, thereby, the loss of safety factors associated with the tubing and casing designs.

Even though there are guidelines and best practices based on industry standards, the absence of clear guidelines may result in costly well maintenance. The use of data from the wells can thus, be used to estimate risk and predict trends.

Figure 6:
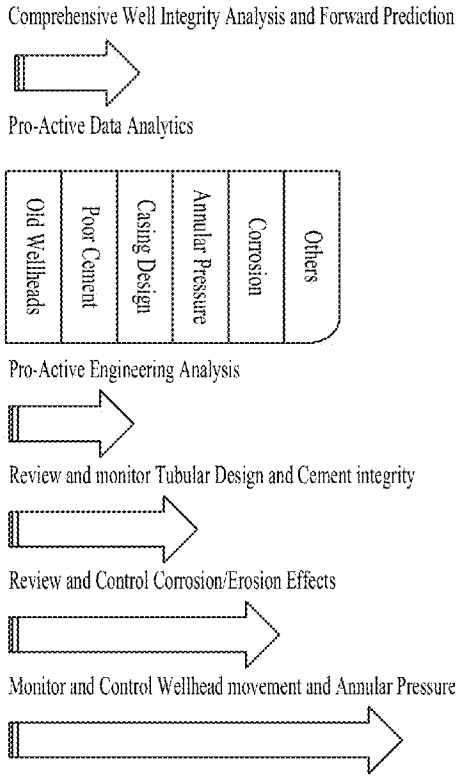
FIG. 6 is a correlation chart illustrating a correlation between continuously monitored well data and coupled engineering analyses.

Real-time can be used to compare against historic data for determining the need for remedial action. Data trending, data analysis and data mining are also important. The raw data can be cleaned and filtered depending on the area for processing and analysis. The data can be further used either for analytical calculation or artificial-intelligence-based analysis. In the data-gathering stage, a variety of continuously measured well data are transferred and stored in an online historian database. The collected data can be used for the analysis in FIG. 6, which is a correlation chart illustrating a correlation between continuously monitored well data and the various coupled engineering analyses. In addition, the collected data may be used for:

- engineering models as well as artificial-intelligence-based models;
- calibration of the engineering model;
- trend analysis of operational parameters;
- setting limits; and
- identifying the long-term and short-term trends.

In this manner, the deviation from the normal may be quantified and compared against the engineering models.

Figure 7:
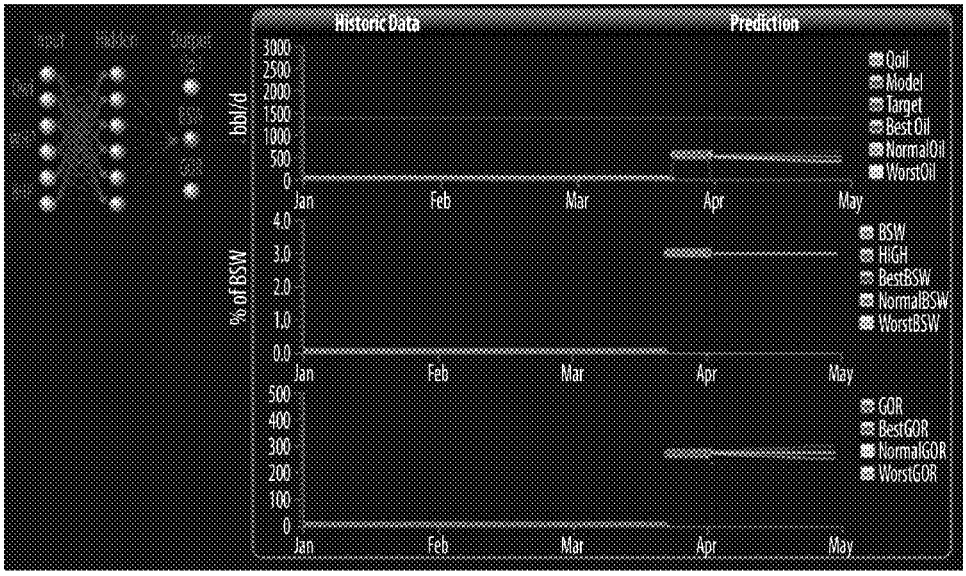
FIG. 7 is a graphical display illustrating a trend prediction for specific variables related to a well.

Use of historic data is also important to check the trend in failures aside from monitoring the pressure signature prior to failure for forward prediction. The trend using the historical data can be used to estimate the probability of failure and calibrate the engineering models. In FIG. 7, a graphical display illustrates a trend prediction for specific variables related to a hypothetical well and well data as an exemplary reference. In this case, the upper trend is the oil produced, the middle trend is the water cut and the lower trend is the gas-oil ratio. Each trend is based on multiple time series of data. The left portion, approximately 75%, shows the historical data of the actual values and the model predictions for the time interval. This display enables the user to monitor the accuracy of the model over time. The right portion of each trend projects the model predictions across the next 30 days if all inputs (for example, the injection rate of the pattern injector) remain constant. The prediction model can be either with a neural network algorithm, support-vector machines or fuzzy logic.

Because artificial-intelligence models are a statistical model and the inputs contain some degree of uncertainty in their values, the outputs (or predictions) also contain uncertainty. The trends show the uncertainty of the output prediction (oil rate, gas-oil ratio, and water cut) with three lines. The central line is the best average prediction. The upper line represents the value at the second standard deviation value of uncertainty, and the lower value is the prediction at the minus 2 standard deviations of uncertainty. The final value on the oil-production rate and water-cut plots is a horizontal line that represents the target production for oil rate and the upper limit for water cut. The nomenclature used herein is described in Table 1 below.

TABLE 1

| | |
|---|---|
| d | casing diameter, in. |
| $d_o$ | outside diameter of the tubular structure, in. |
| Δd | change in the casing diameter, in. |
| D | annulus gap between the casings, in. |
| $f_{co2}$ | fugacity of $CO_2$ |
| i | number of casing sections |
| j | number of annulus |
| $K_{tg}$ | stress concentration factor (SCF) |
| l | segment length of the exposed casing, ft |
| Δl | wellhead growth, in. |
| n | number of exposed casing sections |
| m | number of casings |
| $P_b$ | burst pressure-rating of the material, psi |
| T | tubular structure wall thickness, in. |
| SCF | Stress concentration factor |
| T | Temperature (K) |
| V | annulus volume, $ft^3$ |
| $v_a$ | volumetric change due to annulus pressures |
| ΔV | change in the annulus volume, $ft^3$ |
| WHI | wellhead growth index |
| $\sigma_y$ | yield strength, psi |

Referring now to FIG. 1, a flow diagram of one embodiment of a method 100 for implementing the present disclosure is illustrated. The method 100 performs a coupled engineering analysis for well integrity management during all operations throughout the life of the well starting from drilling, through completion and later production. Drilling activities are related to operations such as tripping in, tripping out, drilling, sliding, backreaming and other operations. The operational parameters are monitored such as weight on bit, flowrate and fluid related parameters during drilling. The completion activities are related to completion and workover operations to check the tubing related integrity along with the integrity of other related downhole completion tools. It also affects the casing exposed to completion operation and fluid. The production activities are related to production of fluids such as oil, gas and water. The production operation may affect the casing and tubing due to corrosion and erosion. The coupled engineering analysis will couple all these underlying operations and the calculation of one parameter will affect the other calculations in the relevant loop.

In step 102, the well temperature and pressure are determined using extrapolations from nearby well logs or real data from the nearby well logs using well known engineering calculations. Depending on the state of the well and the preferred analysis, steps 104, 106 and 108 may be performed next in any order or simultaneously. Depending on the temperature and pressure, the coupled engineering analysis may vary to the extent the calculations are different.

In step 104, a drilling engineering analysis is performed using the well temperature and pressure determined in step 102. One embodiment of a method for performing this step is described further in reference to FIG. 2.

In step 106, a completion engineering analysis is performed using the well temperature and pressure determined in step 102. One embodiment of a method for performing this step is described further in reference to FIG. 3.

In step 108, a production engineering analysis is performed using the well temperature and pressure determined in step 102. One embodiment of a method for performing this step is described further in reference to FIG. 5.

In step 110, the method 100 determines whether the entire life cycle of the well is complete. If the entire life cycle of the well is not complete, then the method 100 returns to step 102 where the well temperature and pressure are updated based on a new set of real-time data measured for the well. If the entire life cycle of the well is complete, then the method 100 ends.

Figure 2:
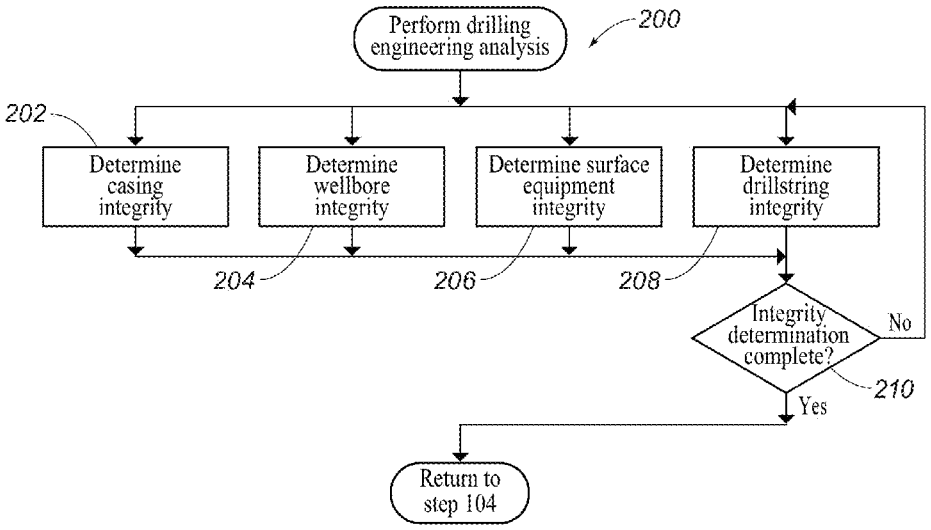
FIG. 2 is a flow diagram illustrating one embodiment of a method for performing step 104 in FIG. 1.

Referring now to FIG. 2, a flow diagram of one embodiment of a method 200 for performing step 104 in FIG. 1 is illustrated. Depending on the well temperature and pressure determined in step 102, steps 202-208 may be performed next in any order or simultaneously.

In step 202, the casing integrity is determined. One embodiment of a method for performing this step is described further in reference to FIG. 4A. Another embodiment of a method for performing this step is described further in reference to FIG. 4B.

In step 204, the well bore integrity is determined using techniques well known in the art. The well bore integrity is used to maintain the well bore within the operating mud weight window, and prevent losing the well bore due to excess pressure at the bottom and complete loss of mud or a well bore collapse.

In step 206, the surface equipment integrity is determined using techniques well known in the art. The surface equipment integrity is used to maintain all of the surface equipment within predetermined operating temperature and pressure ranges and to prevent any failures.

In step 208, the drill string integrity is determined using techniques well known in the art. The drill string integrity is used to estimate the stresses, fatigue limits, buckling conditions, and stretching along with the other operating parameters of the drill string and to prevent any loss of drill string in the well bore due to material failure or differential sticking.

In step 210, the method 200 determines if the integrity determination for the casing, wellbore, surface equipment and drillstring is complete. If the integrity determination is not complete, then the method 200 returns to steps 202-208 until the integrity determination is complete for the casing, wellbore, surface equipment and drillstring. If the integrity determination is complete, then the method 200 returns to step 104 in FIG. 1.

Figure 3:
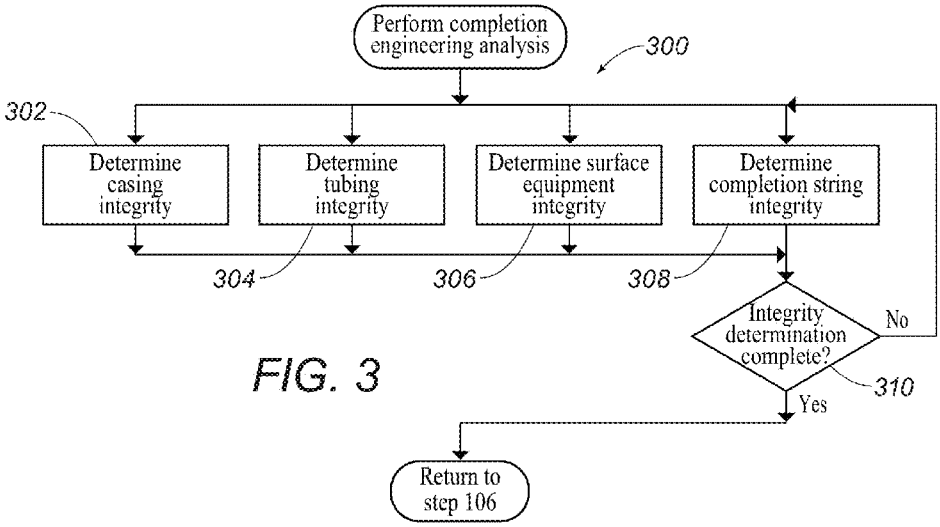
FIG. 3 is a flow diagram illustrating one embodiment of a method for performing step 106 in FIG. 1.

Referring now to FIG. 3, a flow diagram of one embodiment of a method 300 for performing step 106 in FIG. 1 is illustrated. Depending on the well temperature and pressure determined in step 102, steps 302-308 may be performed next in any order or simultaneously.

In step 302, the casing integrity is determined. One embodiment of a method for performing this step is described further in reference to FIG. 4A. Another embodiment of a method for performing this step is described further in reference to FIG. 4B.

In step 304, the tubing integrity is determined using techniques well known in the art. The tubing integrity is used to estimate the stresses, fatigue limits, and metal losses due to corrosion or erosion and to maintain the operating conditions within the specified ranges of temperature and pressure. Use of proper tubing loads is important to estimate the design safety factors and, thereby, the well integrity. Some of the loads that need to be considered are:

- burst condition due to a tubing leak (this load can be used for both production and injection scenarios representing high-surface pressure: a worst-case scenario based on gas gradient extending upward from the reservoir pressure at the perforation may also be considered);
- burst condition due to stimulation surface leaks (injection pressure at the top of the production annulus as a result of tubing leak at the surface can also be considered as a worst-case scenario); and
- burst condition due to injection down through the casing (this may be encountered from operations, such as fracturing operations).

Figure 8:
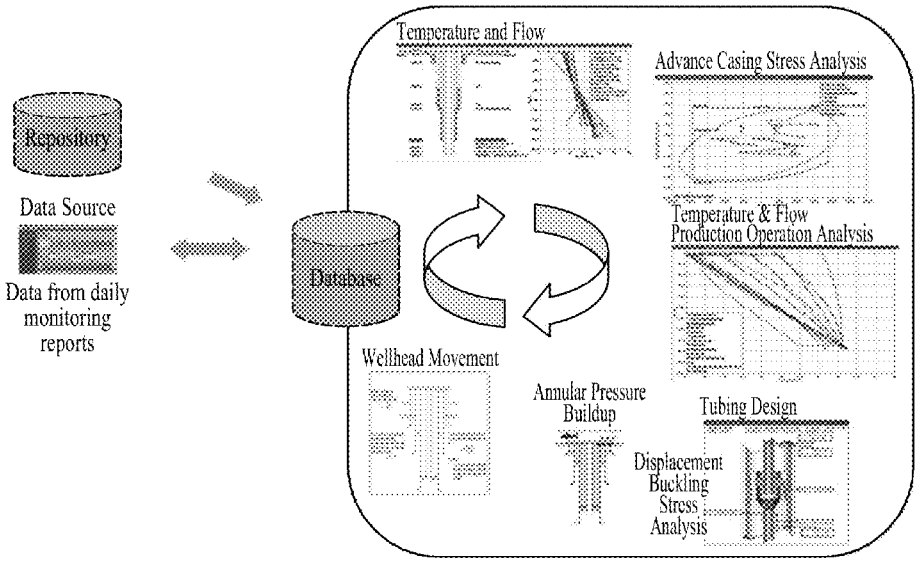
FIG. 8 is a workflow diagram illustrating the engineering calculations involved in estimating a tubing safety factor.

An example of the engineering calculations involved in estimating a tubing safety factor is illustrated by the workflow diagram in FIG. 8. The workflow involves the retrieval of wellbore and other production data from a repository and performs the following calculations:

- temperature and flow analysis;
- basic and advanced casing/tubing stress analysis;
- wellhead movement calculations;
- annular pressure build-up estimation; and
- casing/tubing safety factors estimation.

In step 306, the surface equipment integrity is determined using techniques well known in the art. The surface equipment integrity is used to maintain all of the surface equipment within predetermined operating temperature and pressure ranges and to prevent any failures.

In step 308, the completion string integrity is determined using techniques well known in the art. The completion string integrity is used to estimate the stresses, fatigue limits, buckling conditions, and stretching along with the other operating parameters of the completion string and to prevent any loss of completion string in the well bore due to failure.

In step 310, the method 300 determines if the integrity determination for the casing, tubing, surface equipment and completion string is complete. If the integrity determination is not complete, then the method 300 returns to steps 302-308 until the integrity determination is complete for the casing, wellbore, surface equipment and completion string. If the integrity determination is complete, then the method 300 returns to step 106 in FIG. 1.

Figure 4A:
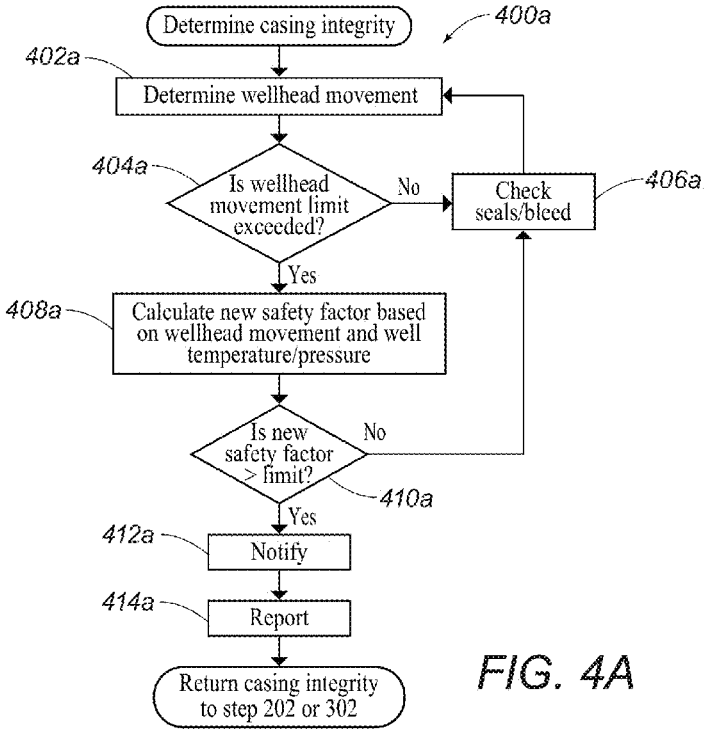
FIG. 4A is a flow diagram illustrating one embodiment of a method for performing steps 202 and 302 in FIGS. 2 and 3, respectively.
Figure 9:
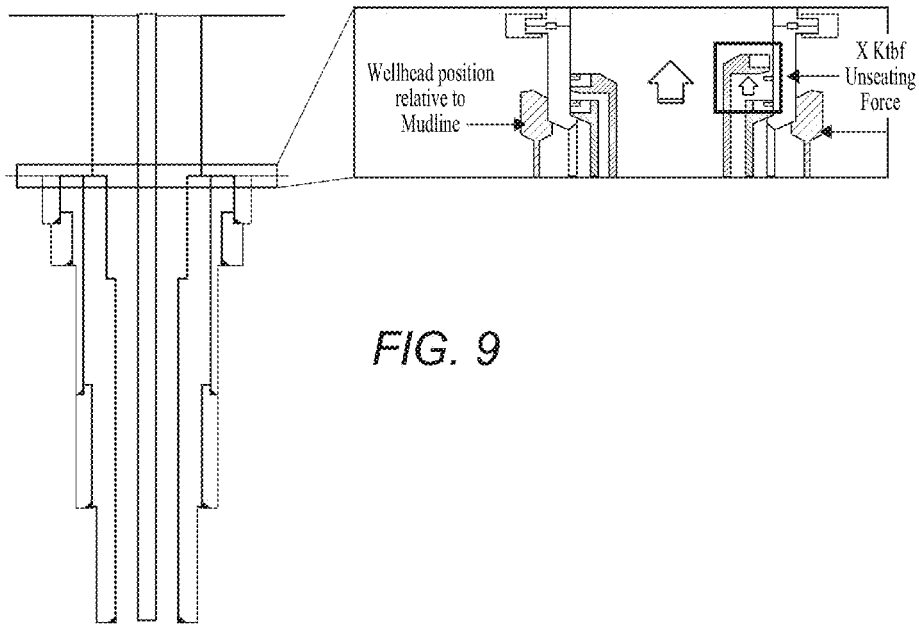
FIG. 9 is a cross-section elevational view of a wellhead illustrating the criterion relevant to the design of ultra-deep wells.

Referring now to FIG. 4A, a flow diagram of one embodiment of a method 400*a* for performing steps 202 and 302 in FIGS. 2 and 3, respectively, is illustrated. The casing in a well constitutes a significant portion of the cost, which requires an alternate approach to the casing-design criterion—particularly for high temperatures and high pressures that are encountered in ultra-deep wells. Challenges associated with extreme depth, pressures, and temperatures, where annular fluid expansion is a problem, translate to additional problems, not only in casing integrity, but also at the wellhead as illustrated by the cross-section elevational view of a wellhead in FIG. 9. It is, therefore, required to align design objectives closer to the changed requirements, which necessitates changes in traditional casing design methods. The design implemented should be without sacrificing the safety and integrity of the well. The intricate nature of relational expressions can also be a hindrance in comparing different designs under certain conditions.

In step 402*a*, wellhead movement is determined by monitoring a wellhead growth index (WHI). WHI is a parameter that encapsulates the annuli fluid expansion and provides a simple, practical way to view not only the casing movement, but also the fluid expansion in the annuli during the course of drilling. It is defined as the ratio of the annular fluid expansion of the casing to the actual volume of the exposed segment above the top of the cement. The annular fluid expansion includes the unconstrained volume change and the annulus volume change owing to annulus pressures. Wellhead growth or movement gives an estimate of the circumferential and axial strain on the casings. With the circumferential and lateral strain, the total volume of the expansion of all casing strings for all casing segments is given by:

$$\Delta V = \sum_{j=1}^{m}\sum_{i=1}^{n}\left[\frac{\pi}{4}(2d\Delta dl + d^2\Delta l) + v_a\right]_{i,j} \tag{A1}$$

The total area of annulus cross-section for each casing string is given by:

$$a = \sum\sum\frac{\pi}{4}(D^2)\Big|_{i,j} \tag{A2}$$

Using equation A1 and equation A2 with approximations, the WHI for multiple casing strings is given by:

$$WHI = \frac{\sum_{j=1}^{m}\sum_{i=1}^{n}\left[\frac{\pi}{4}(2d\Delta dl + d^2\Delta l) + v_a\right]_{i,j}}{\sum\sum\frac{\pi}{4}(D^2)\Big|_{i,j}\, l} \tag{A3}$$

WHI gives a quantitative predictive capability to interpret the integrity of the casing in real time. The higher the WHI, the higher the severity of the casing design will be. Calculation of WHI at different stages of the casing design will aid in comparing the relative rigorousness of the overall casing design.

In step 404*a*, the method 400*a* determines if the wellhead movement limit is exceeded by comparing the observed wellhead movement with a predetermined wellhead movement limit. If the wellhead movement limit is exceeded, then the method 400*a* proceeds to step 408*a*. If the wellhead movement limit is not exceeded, then the method 400*a* proceeds to step 406*a*.

In step 406*a*, operating seals at the wellhead are checked for any increase in annular pressure due to movement of the wellhead and any additional annular pressure is relieved by bleeding off the additional annular pressure.

In step 408*a*, a new safety factor is calculated based on the observed wellhead movement and the well temperature/pressure using techniques well known in the art.

In step 410*a*, the method 400*a* determines if the new safety factor is greater than a predetermined limit. If the new safety factor is not greater than the limit, then the method 400*a* returns to step 406*a*. If the new safety factor is greater than the limit, then the method 400*a* proceeds to step 412*a*.

In step 412*a*, a notification is sent to shut in the well and implement remedial measures to prevent failure of the casing string.

In step 414*a*, a status report is sent that recommends specific remedial measures to be taken in order for the well to become operational again and the method 400*a* returns the casing integrity to step 202 or 302.

Figure 4B:
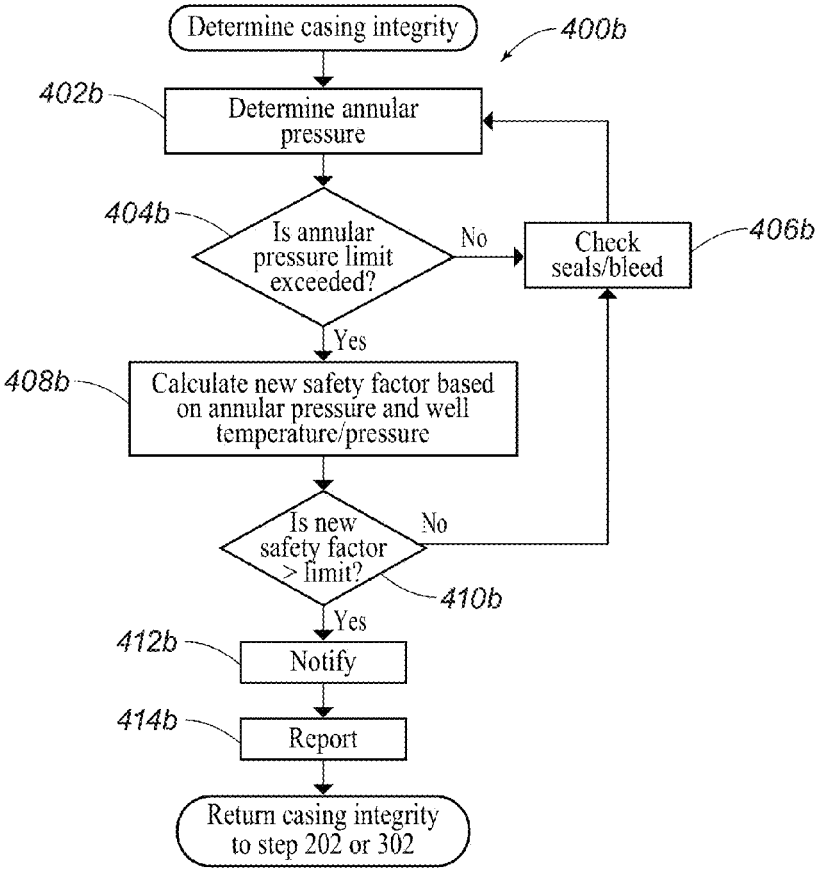
FIG. 4B is a flow diagram illustrating another embodiment of a method for performing steps 202 and 302 in FIGS. 2 and 3, respectively.

Referring now to FIG. 4B, a flow diagram of another embodiment of a method 400*b* for performing steps 202 and 302 in FIGS. 2 and 3, respectively, is illustrated.

In step 402*b*, annular pressure is determined by monitoring the annular pressure observed in the annulus of a well. The pressures can be specified and can be different for gas-injection wells.

Figure 10:
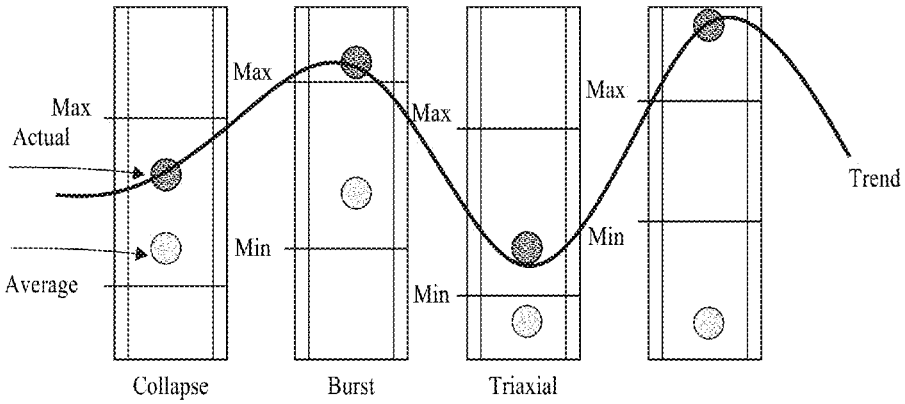
FIG. 10 is a graphical display illustrating the maximum and minimum limits of various annular pressures and the actual/average values for each with a trend.

In step 404*b*, the method 400*b* determines if the annular pressure limit is exceeded by comparing the observed annular pressure with a predetermined annular pressure limit. If the annular pressure limit is exceeded, then the method 400*b* proceeds to step 408*b*. If the annular pressure limit is not exceeded, then the method 400*b* proceeds to step 406*b*. An example of maximum and minimum limits of various annular pressures and the actual/average values for each with a trend is illustrated by the graphical display in FIG. 10.

In step 406*b*, operating seals at the wellhead are checked for any increase in annular pressure and any additional annular pressure is relieved by bleeding off the additional annular pressure.

In step 408*b*, a new safety factor is calculated based on the observed annular pressure and the well temperature/pressure using techniques well known in the art.

In step 410*b*, the method 400*b* determines if the new safety factor is greater than a predetermined limit. If the new safety factor is not greater than the limit, then the method 400*b* returns to step 406*b*. If the new safety factor is greater than the limit, then the method 400*b* proceeds to step 412*b*.

In step 412*b*, a notification is sent to shut in the well and implement remedial measures to prevent failure of the casing string.

In step 414*b*, a status report is sent that recommends specific remedial measures to be taken in order for the well to become operational again and the method 400*b* returns the casing integrity to step 202 or 302.

Figure 5:
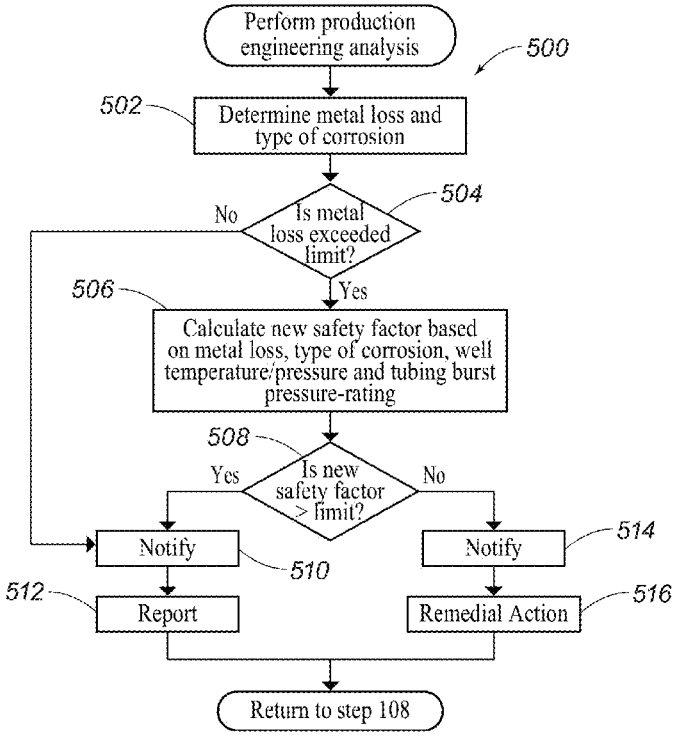
FIG. 5 is a flow diagram illustrating one embodiment of a method for performing step 108 in FIG. 1.

Referring now to FIG. 5, a flow diagram of one embodiment of a method 500 for performing step 108 in FIG. 1 is illustrated.

In step 502, the metal loss and type of corrosion are determined for the tubing using techniques well known in the art. The amount of metal loss and type of corrosion may be used to determine whether the tubing will withstand operational loads. The type of corrosion is important because the pipe can quickly weaken so that it can no longer withstand operating loads. The most severe forms of corrosions are sulfide stress-corrosion cracking, chloride-stress cracking, and hydrogen embrittlement. Like tubular wear, corrosion can have a major detrimental effect on the mechanical integrity of tubular systems and should be included in the tubular design. Corrosion pits act as stress risers and decrease the pressure integrity of the tubing, which further results in tubing failure. Pitting corrosion studies indicate that pitting corrosion is a localized form of corrosion by which holes are produced in the structural wall. Pitting causes localized attack on the tubing and is one of the most destructive forms of corrosion. The loss of weight owing to pits is much less and, thus, makes it difficult to detect the intensity of pitting corrosion. The most damaging load for tubing is the burst load. Burst loads to the well tubing is originated from the column of production fluid, which holds a very high pressure and acts on the inside wall of the tubular structure. Even though the tubing is designed initially with proper safety factors, the change in the loading condition during the life of the well may lead to bursting of tubing owing to degradation of the tubing strength caused by corrosion. The corrosion rate (CR), also known as metal loss, can be calculated using the following equations:

$$CR = Kf_{CO_2}\left(\frac{S}{19}\right)^{0.146+0.0324\log f_{CO_2}} f(\text{pH})\text{mm/yr} \tag{A4}$$

where constants (K) and f(pH) are based on different temperatures and $$CR = F_k 10^{5.8-\frac{1710}{T}+0.67\log f_{CO_2}}\ \text{mm/yr} \tag{A5}$$

In step 504, the method 500 determines if the metal loss limit is exceeded by comparing the actual metal loss with a predetermined metal loss limit. If the metal loss limit is not exceeded, then the method 500 proceeds to step 510. If the metal loss limit is exceeded, then the method 500 proceeds to step 506.

In step 506, a new safety factor is calculated based on the actual metal loss, the type of corrosion, the well temperature/pressure and an updated tubing burst pressure-rating using techniques well known in the art. The stress concentration factors (SCF) formulae can be applied directly into the tubing pressure-rating equation to predict the degraded pressure-ratings. The predicted results can be used in both designing and evaluating tubing strength with sphere-like cavities at a surface. The American Petroleum Institute (API) burst pressure-rating is given by the following equation:

$$P_b = 0.875 \times 2\sigma_y\left(\frac{1}{d_0/t}\right) \tag{A6}$$

Figure 11:
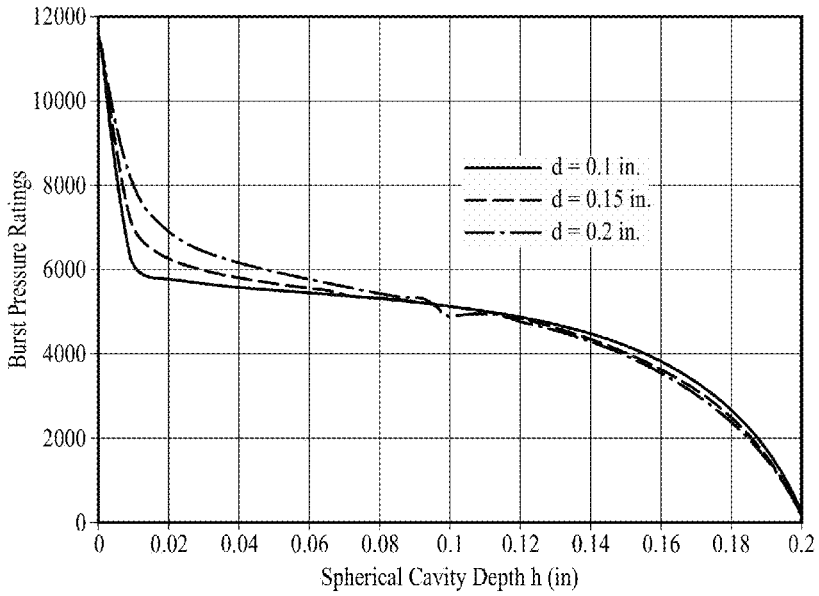
FIG. 11 is a graphical display illustrating burst pressure-ratings for tubing relative to spherical cavity depth.

Applying the approximate SCF formulae to the API burst pressure-rating formula yields:

$$P_b = 0.875 \times 2\sigma_y\left(\frac{1}{d_0/t}\right)\left(\frac{1}{K_{tg}}\right) \tag{A7}$$

where ($K_{tg}$) represents the stress concentration factor (SCF) and ($P_b$) represents the updated tubing burst pressure-rating. The above expression can be used to estimate de-rated tubing strength with spherical cavities for different geometries. In FIG. 11, for example, burst pressure-ratings for tubing (QT-1000 3.5×3.094) relative to spherical cavity depth are illustrated in a graphical display, which can be easily used by production engineers.

In step 508, the method 500 determines if the new safety factor is greater than a predetermined limit. If the new safety factor is not greater than the limit, then the method 500 proceeds to step 514. If the new safety factor is greater than the limit, then the method 500 proceeds to step 510.

In step 510, a notification is sent to shut in the well and implement remedial measures to prevent failure of the tubing string In step 512, a status report is sent that recommends specific remedial measures to be taken in order for the well to become operational again and the method 500 returns the corrosion state to step 108.

In step 514, a notification is sent describing the actual metal loss and type of corrosion in the well and to implement remedial measures to prevent further metal loss due to corrosion.

In step 516, remedial action is implemented based on the notification describing the actual metal loss and type of corrosion in the well and the method 500 returns the corrosion state to step 108.

Regarding steps 412*a*, 412*b*, 510 and 514, the notifications may further include the following primary color-coded barrier limits, which are merely guidelines:

Green:
- No changes
- Well barrier working properly

Yellow:
- One barrier has been damaged but still works acceptably. Other barriers work properly.
- Well still working properly
- No workover is required Red:
- One or more barriers has been damaged and the well is not working properly
- High blowout probability
- Workover required The workflow for sour service management is similar to the method 500 in FIG. 5. In this workflow, the yield strength of the tubing string is determined and monitored if the well is experiencing sour environments. The National Association of Corrosion Engineers standard MR0175 provides the material selection for sour environments and the material requirements. It also provides the proprietary grades and corrosion-resistant alloy (CRA) materials suitable for use in sour environment. Different materials can be used at different depths in the wellbore based on a temperature profile and the expected operating maximum temperature. Usually, the undisturbed temperature profile is often used for the design because it represents a conservative estimate of the minimum steady-state temperature that the pipe could experience while exposed to the sour environment. The axial, collapse, and burst-design factors should be adjusted to account for the sour zones encountered at various sections of the well. The design factors need to be modified depending on the condition and production loads.

The workflow for erosion management is similar to the method 500 in FIG. 5. In this workflow, the erosional velocity, erosion rate and severity is monitored along with the observed metal loss to determine the erosional effects observed by the tubing string. Unlike corrosion, erosion is a mechanical process by which the thickness of the tubulars are reduced. When erosional velocity exceeds the threshold value, the metal reduction will be faster, which will result in the loss of wall thickness and, thereby, reduction in the operational safety factor. The threshold velocity is given by the equation:

$$V_c = c\sqrt{\rho} \text{ ft/sec} \quad \text{(A8)}$$

where (c) is a constant and is 100 for long-life projects, 150 for short-life projects, and greater than 200 for peak-flow projects. The erosion-corrosion rate can be given by the equation:

$$ECR = cV^n \text{ ft/sec} \quad \text{(A9)}$$

where (v) is the flow velocity and the exponent (n) varies between 1 and 3, depending on whether it is corrosion or erosion. For corrosion (n) is closer to 1 and for erosion (n) is closer to 3.

The erosivity can be estimated using the following equation:

$$ECR = C_o F_{sat}{}^{C} \times f_1 \times f_{pH} \text{ mm/yr} \quad \text{(A10)}$$

The coupled engineering analysis can be done on a single well basis or multi-well basis. Similarly, it can also be done for a single asset for all the wells in that asset as well as can be done on a multi-asset basis to couple the complex engineering analysis. It would then become comprehensive asset integrity management. All the wells in a particular asset can be analyzed by their respective well numbers or their respective locations in the field by visualization.

System Description

The present disclosure may be implemented through a computer-executable program of instructions, such as program modules, generally referred to as software applications or application programs executed by a computer. The software may include, for example, routines, programs, objects, components and data structures that perform particular tasks or implement particular abstract data types. The software forms an interface to allow a computer to react according to a source of input. DecisionSpace® which is a commercial software application marketed by Landmark Graphics Corporation, may be used as an interface application to implement the present disclosure. The software may also cooperate with other code segments to initiate a variety of tasks in response to data received in conjunction with the source of the received data. The software may be stored and/or carried on any variety of memory such as CD-ROM, magnetic disk, bubble memory and semiconductor memory (e.g. various types of RAM or ROM). Furthermore, the software and its results may be transmitted over a variety of carrier media such as optical fiber, metallic wire and/or through any of a variety of networks, such as the Internet.

Moreover, those skilled in the art will appreciate that the disclosure may be practiced with a variety of computer-system configurations, including hand-held devices, multiprocessor systems, microprocessor-based or programmable-consumer electronics, minicomputers, mainframe computers, and the like. Any number of computer-systems and computer networks are acceptable for use with the present disclosure. The disclosure may be practiced in distributed-computing environments where tasks are performed by remote-processing devices that are linked through a communications network. In a distributed-computing environment, program modules may be located in both local and remote computer-storage media including memory storage devices. The present disclosure may therefore, be implemented in connection with various hardware, software or a combination thereof, in a computer system or other processing system.

Figure 12:
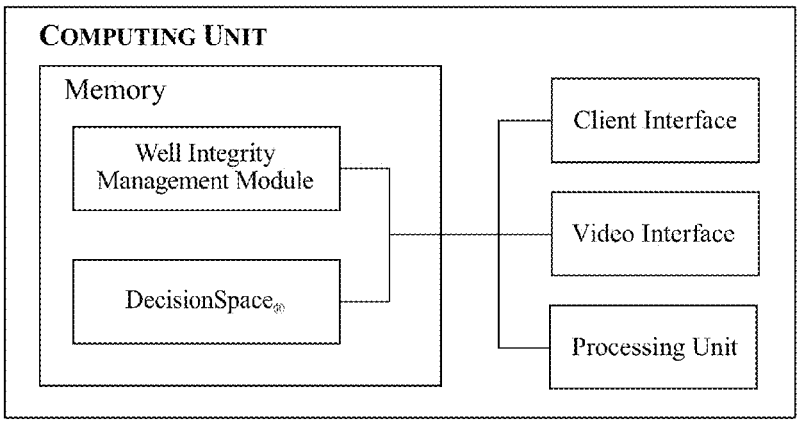
FIG. 12 is a block diagram illustrating one embodiment of a system for implementing the present disclosure.

Referring now to FIG. 12, a block diagram illustrates one embodiment of a system for implementing the present disclosure on a computer. The system includes a computing unit, sometimes referred to as a computing system, which contains memory, application programs, a client interface, a video interface, and a processing unit. The computing unit is only one example of a suitable computing environment and is not intended to suggest any limitation as to the scope of use or functionality of the disclosure.

The memory primarily stores the application programs, which may also be described as program modules containing computer-executable instructions, executed by the computing unit for implementing the present disclosure described herein and illustrated in FIGS. 1-11. The memory therefore, includes a well integrity management module, which enables the data processing steps described in reference to FIGS. 1-5. The well integrity management module may integrate functionality from the remaining application programs illustrated in FIG. 12. In particular, DecisionSpace® may be used as an interface application to acquire the data processed by the well integrity management module. DecisionSpace® includes modules for drilling, production and geology. Although DecisionSpace® may be used as interface application, other interface applications may be used, instead, or the well integrity management module may be used as a stand-alone application.

Although the computing unit is shown as having a generalized memory, the computing unit typically includes a variety of computer readable media. By way of example, and not limitation, computer readable media may comprise computer storage media and communication media. The computing system memory may include computer storage media in the form of volatile and/or nonvolatile memory such as a read only memory (ROM) and random access memory (RAM). A basic input/output system (BIOS), containing the basic routines that help to transfer information between elements within the computing unit, such as during start-up, is typically stored in ROM. The RAM typically contains data and/or program modules that are immediately accessible to, and/or presently being operated on, the processing unit. By way of example, and not limitation, the computing unit includes an operating system, application programs, other program modules, and program data.

The components shown in the memory may also be included in other removable/nonremovable, volatile/nonvolatile computer storage media or they may be implemented in the computing unit through an application program interface ("API") or cloud computing, which may reside on a separate computing unit connected through a computer system or network. For example only, a hard disk drive may read from or write to nonremovable, nonvolatile magnetic media, a magnetic disk drive may read from or write to a removable, nonvolatile magnetic disk, and an optical disk drive may read from or write to a removable, nonvolatile optical disk such as a CD ROM or other optical media. Other removable/nonremovable, volatile/nonvolatile computer storage media that can be used in the exemplary operating environment may include, but are not limited to, magnetic tape cassettes, flash memory cards, digital versatile disks, digital video tape, solid state RAM, solid state ROM, and the like. The drives and their associated computer storage media discussed above provide storage of computer readable instructions, data structures, program modules and other data for the computing unit.

A client may enter commands and information into the computing unit through the client interface, which may be input devices such as a keyboard and pointing device, commonly referred to as a mouse, trackball or touch pad. Input devices may include a microphone, joystick, satellite dish, scanner, or the like. These and other input devices are often connected to the processing unit through the client interface that is coupled to a system bus, but may be connected by other interface and bus structures, such as a parallel port or a universal serial bus (USB).

A monitor or other type of display device may be connected to the system bus via an interface, such as a video interface. A graphical user interface ("GUI") may also be used with the video interface to receive instructions from the client interface and transmit instructions to the processing unit. In addition to the monitor, computers may also include other peripheral output devices such as speakers and printer, which may be connected through an output peripheral interface.

Although many other internal components of the computing unit are not shown, those of ordinary skill in the art will appreciate that such components and their interconnection are well known.

While the present disclosure has been described in connection with presently preferred embodiments, it will be understood by those skilled in the art that it is not intended to limit the disclosure to those embodiments. It is therefore, contemplated that various alternative embodiments and modifications may be made to the disclosed embodiments without departing from the spirit and scope of the disclosure defined by the appended claims and equivalents thereof.

The invention claimed is:

1. A method for well integrity management using a coupled engineering analysis, which comprises:

a) performing drilling operations and a drilling engineering analysis based on a temperature and a pressure for a well during the drilling operations using a computer processor, wherein the drilling engineering analysis determines a casing integrity, a wellbore integrity, a surface equipment integrity and a drillstring integrity;

b) performing completion operations and a completion engineering analysis based on a temperature and a pressure for the well during the completion operations using the computer processor, wherein the completion engineering analysis determines a casing integrity, a tubing integrity, a surface equipment integrity and a completion string integrity; and c) performing production operations and a production engineering analysis based on a temperature and a pressure for the well during the production operations using the computer processor, wherein the production engineering analysis determines at least one of a metal loss, a type of corrosion, a tubing yield strength, an erosion velocity and an erosion rate.

2. The method of claim 1, wherein the well temperature and the well pressure are determined using extrapolations of data from one or more well logs for the well or the data from the well logs.

3. The method of claim 1, further comprising repeating the steps in claim 1 until a life cycle of the well is complete.

4. The method of claim 1, wherein determining the casing integrity comprises:

a) determining movement of a wellhead for the well;

b) determining if the wellhead movement exceeds a predetermined wellhead movement limit;

c) checking operating seals at the wellhead for an increase in annular pressure or calculating a new safety factor based on the wellhead movement, the temperature of the well and the pressure of the well; and d) repeating steps a)-c) until the new safety factor is greater than a predetermined limit.

5. The method of claim 1, wherein determining the casing integrity comprises:

a) determining an annular pressure for the well;

b) determining if the annular pressure exceeds a predetermined annular pressure limit;

c) checking operating seals at a wellhead for the well for an increase in annular pressure or calculating a new safety factor based on the annular pressure, the temperature of the well and the pressure of the well; and d) repeating steps a)-c) until the new safety factor is greater than a predetermined limit.

6. The method of claim 1, wherein performing the production engineering analysis comprises:

a) determining a metal loss and a type of corrosion for tubing in the well;

b) determining if the metal loss exceeds a predetermined metal loss limit; and c) calculating a new safety factor based on the metal loss, the type of corrosion, the temperature of the well, the pressure of the well and a tubing burst pressure-rating.

7. The method of claim 6, further comprising determining if the new safety factor is greater than a predetermined limit.

8. A non-transitory program carrier device tangibly carrying computer executable instructions for well integrity management using a coupled engineering analysis, the instructions being executable to implement:

a) performing drilling operations and a drilling engineering analysis based on a temperature and a pressure for a well during the drilling operations, wherein the drilling engineering analysis determines a casing integrity, a wellbore integrity, a surface equipment integrity and a drillstring integrity;

b) performing completion operations and a completion engineering analysis based on a temperature and a pressure for the well during the completion operations, wherein the completion engineering analysis determines a casing integrity, a tubing integrity, a surface equipment integrity and a completion string integrity; and c) performing production operations and a production engineering analysis based on a temperature and a pressure for the well during the production operations, wherein the production engineering analysis determines at least one of a metal loss, a type of corrosion, a tubing yield strength, an erosion velocity and an erosion rate.

9. The program carrier device of claim 8, wherein the well temperature and the well pressure are determined using extrapolations of data from one or more well logs for the well or the data from the well logs.

10. The program carrier device of claim 8, further comprising repeating the steps in claim 1 until a life cycle of the well is complete.

11. The program carrier device of claim 8, wherein determining the casing integrity comprises:

a) determining movement of a wellhead for the well;

b) determining if the wellhead movement exceeds a predetermined wellhead movement limit;

c) checking operating seals at the wellhead for an increase in annular pressure or calculating a new safety factor based on the wellhead movement, the temperature of the well and the pressure of the well; and d) repeating steps a)-c) until the new safety factor is greater than a predetermined limit.

12. The program carrier device of claim 8, wherein determining the casing integrity comprises:

a) determining an annular pressure for the well;

b) determining if the annular pressure exceeds a predetermined annular pressure limit;

c) checking operating seals at a wellhead for the well for an increase in annular pressure or calculating a new safety factor based on the annular pressure, the temperature of the well and the pressure of the well; and d) repeating steps a)-c) until the new safety factor is greater than a predetermined limit.

13. The program carrier device of claim 8, wherein performing the production engineering analysis comprises:

a) determining a metal loss and a type of corrosion for tubing in the well;

b) determining if the metal loss exceeds a predetermined metal loss limit; and c) calculating a new safety factor based on the metal loss, the type of corrosion, the temperature of the well, the pressure of the well and a tubing burst pressure-rating.

14. The program carrier device of claim 13, further comprising determining if the new safety factor is greater than a predetermined limit.

15. A non-transitory program carrier device tangibly carrying computer executable instructions for well integrity management using a coupled engineering analysis, the instructions being executable to implement:

a) performing drilling operations and a drilling engineering analysis based on a temperature and a pressure for a well during the drilling operations, wherein the drilling engineering analysis determines a casing integrity, a wellbore integrity, a surface equipment integrity and a drillstring integrity;

b) performing completion operations and a completion engineering analysis based on a temperature and a pressure for the well during the completion operations, wherein the completion engineering analysis determines a casing integrity, a tubing integrity, a surface equipment integrity and a completion string integrity;

c) performing production operations and a production engineering analysis based on a temperature and a pressure for the well during the production operations, wherein the production engineering analysis determines a metal loss, a type of corrosion, a tubing yield strength, an erosion velocity and an erosion rate; and d) repeating steps a)-c) until a life cycle of the well is complete.

16. The program carrier device of claim 15, wherein the well temperature and the well pressure are determined using extrapolations of data from one or more well logs for the well or the data from the well logs.

17. The program carrier device of claim 15, wherein determining the casing integrity comprises:

a) determining movement of a wellhead for the well;

b) determining if the wellhead movement exceeds a predetermined wellhead movement limit;

c) checking operating seals at the wellhead for an increase in annular pressure or calculating a new safety factor based on the wellhead movement, the temperature of the well and the pressure of the well; and d) repeating steps a)-c) until the new safety factor is greater than a predetermined limit.

18. The program carrier device of claim 15, wherein determining the casing integrity comprises:

a) determining an annular pressure for the well;

b) determining if the annular pressure exceeds a predetermined annular pressure limit;

c) checking operating seals at a wellhead for the well for an increase in annular pressure or calculating a new safety factor based on the annular pressure, the temperature of the well and the pressure of the well; and d) repeating steps a)-c) until the new safety factor is greater than a predetermined limit.

19. The program carrier device of claim 15, wherein performing the production engineering analysis comprises:

a) determining a metal loss and a type of corrosion for tubing in the well;

b) determining if the metal loss exceeds a predetermined metal loss limit; and c) calculating a new safety factor based on the metal loss, the type of corrosion, the temperature of the well, the pressure of the well and a tubing burst pressure-rating.

20. The program carrier device of claim 19, further comprising determining if the new safety factor is greater than a predetermined limit.

* * * * *